US007696458B2

(12) United States Patent
Thomas et al.

(10) Patent No.: US 7,696,458 B2
(45) Date of Patent: Apr. 13, 2010

(54) INDUCTION HEATING SYSTEM AND METHOD OF OUTPUT POWER CONTROL

(75) Inventors: Jeffrey R. Thomas, Appleton, WI (US); Randall G. Baxter, Black Creek, WI (US); Paul D. Verhagen, Appleton, WI (US); Edward G. Beistle, Appleton, WI (US); Brian J. Veik, Neenah, WI (US)

(73) Assignee: Illinois Tool Works Inc., Glenview, IL (US)

( * ) Notice: Subject to any disclaimer, the term of this patent is extended or adjusted under 35 U.S.C. 154(b) by 231 days.

(21) Appl. No.: 11/144,897

(22) Filed: Jun. 3, 2005

(65) Prior Publication Data

US 2006/0289492 A1 Dec. 28, 2006

(51) Int. Cl.
*H05B 6/04* (2006.01)
*H05B 6/08* (2006.01)

(52) U.S. Cl. ..... 219/660; 219/667

(58) Field of Classification Search ..... 219/660, 219/661, 662, 663, 664, 665, 666, 667, 668, 219/669, 670, 671
See application file for complete search history.

(56) References Cited

U.S. PATENT DOCUMENTS 3,566,243 A 2/1971 Landis
3,816,690 A 6/1974 Mittelmann
4,005,370 A 1/1977 Kusunoki et al.
4,032,740 A * 6/1977 Mittelmann ..... 219/667
4,292,487 A * 9/1981 De Leon ..... 23/296
4,810,847 A 3/1989 Ito
4,949,233 A 8/1990 Braunisch et al.
5,003,141 A 3/1991 Braunisch et al.
5,165,049 A 11/1992 Rotman
5,222,015 A 6/1993 Nakagawa
5,248,866 A 9/1993 Tanaka et al.
5,317,133 A 5/1994 Sundstrom et al.
5,451,750 A 9/1995 An
6,507,008 B2 * 1/2003 Nakayama et al. ..... 219/619

FOREIGN PATENT DOCUMENTS

FR 2680297 2/1993

* cited by examiner

*Primary Examiner*—Daniel Robinson
(74) *Attorney, Agent, or Firm*—Fletcher Yoder

(57) ABSTRACT

A system and method for inductively heating a work piece. The induction heating system is coupleable to at least one temperature feedback device. The temperature feedback device is disposed within the induction heating system to provide a signal representative of the temperature of an induction heating system component. The induction heating system is operable to control the output of the induction heating system based on the temperature of the induction heating system component to protect the component from heat damage.

27 Claims, 5 Drawing Sheets

FIG. 3a
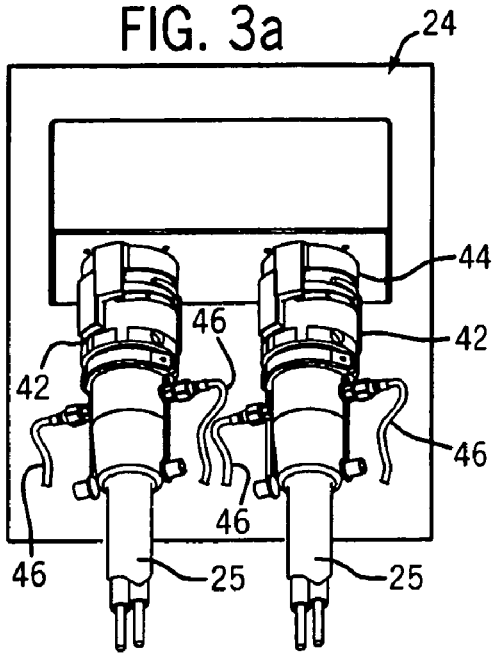
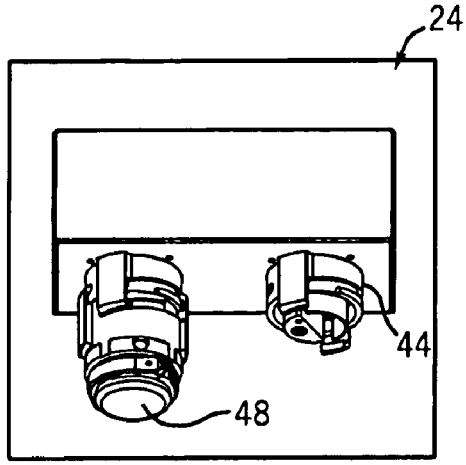
FIG. 3b
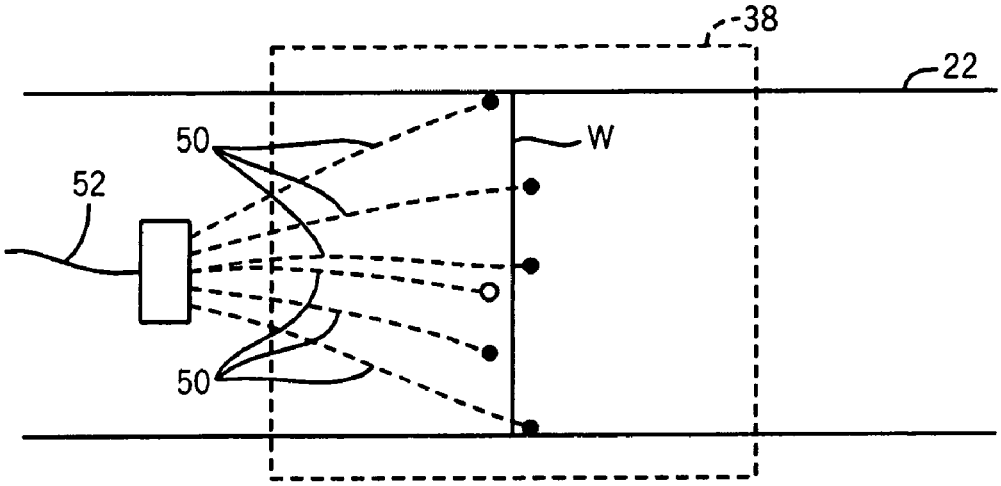
FIG. 4
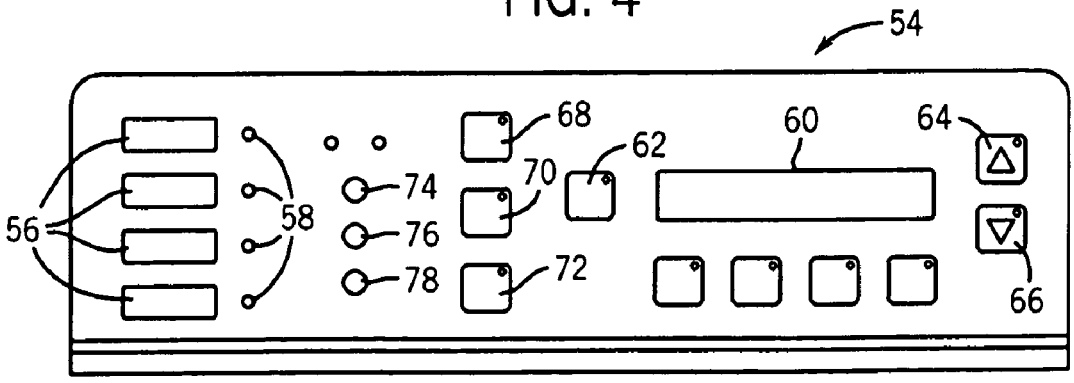
FIG. 5

INDUCTION HEATING SYSTEM AND METHOD OF OUTPUT POWER CONTROL

BACKGROUND OF THE INVENTION

The present invention relates generally to electronic systems and, particularly, to a system and method for controlling the output power of an electronic system based on operating parameters of the electronic system.

An induction heating system is a system that utilizes a varying magnetic field to heat an object. A work piece placed inside or proximate to the induction heating device is exposed to the varying magnetic field. This varying magnetic field induces movement of the electrons within the work piece, causing eddy currents to flow in the work piece. The eddy currents and resistance to current flow within the work piece cause the temperature of the work piece to rise. The amount of heat induced in the work piece may be controlled by changing the magnetic field strength as a result of varying the amount of alternating current flowing through the induction heating device.

An induction heating power source used in an induction heating system may operate with relatively large amounts of electrical current. As a result, the temperature of the components generating or transmitting the electrical current may rise dramatically during operation of the system. To dissipate this heat a liquid may be used to cool some induction heating system components, such as induction heating cables, during operation to prevent heat damage from occurring. However, even these liquid-cooled components may be vulnerable to heat damage when operated at or near their operational limits, or if placed in proximity to an inductively heated object.

In addition, damage may occur to components of the induction heating power source as they are utilized at levels beyond their operating limits. Moreover, the electronic components of the system may be damaged directly by the current flowing through them or the voltage across them. For example, solid-state components, such as transistors, used in the manipulation of electrical current may be especially vulnerable to heat damage caused by the electrical current flowing through them.

Therefore, a technique is desired that will protect electrical components of a system from damage that may occur as a result of the operation of the system. More particularly, a technique is needed for protecting the components of an induction heating system based on operating parameters of the induction heating system.

SUMMARY OF THE INVENTION

In accordance with certain embodiments, the present invention provides systems and methods for inductively heating a work piece. The exemplary induction heating system is coupleable to at least one temperature feedback device. The temperature feedback device is disposed within the induction heating system to provide a signal representative of the temperature of an induction heating system component. The exemplary induction heating system also comprises sensors operable to provide signals representative of other operating parameters of the induction heating system. The induction heating system is operable to control the output of the induction heating system based on the operating parameters of the induction heating system.

BRIEF DESCRIPTION OF THE DRAWINGS

The invention will hereafter be described with reference to the accompanying drawings, wherein like reference numerals denote like elements, and:

FIGS. 3*a* and 3*b* are elevation views of a rear portion of the induction heating system of FIG. 1, FIG. 3*a* illustrating the rear portion with cables attached thereto and FIG. 3*b* illustrating the rear portion without cables attached thereto;

FIG. 4 is an elevation view of a work piece and a plurality of temperature feedback devices disposed on the work piece, according to an exemplary embodiment of the present technique;

FIG. 5 is an elevation view of the control panel of the induction heating system of FIG. 1, according to an exemplary embodiment of the present technique;

DETAILED DESCRIPTION OF THE PREFERRED EMBODIMENTS

Figure 1:
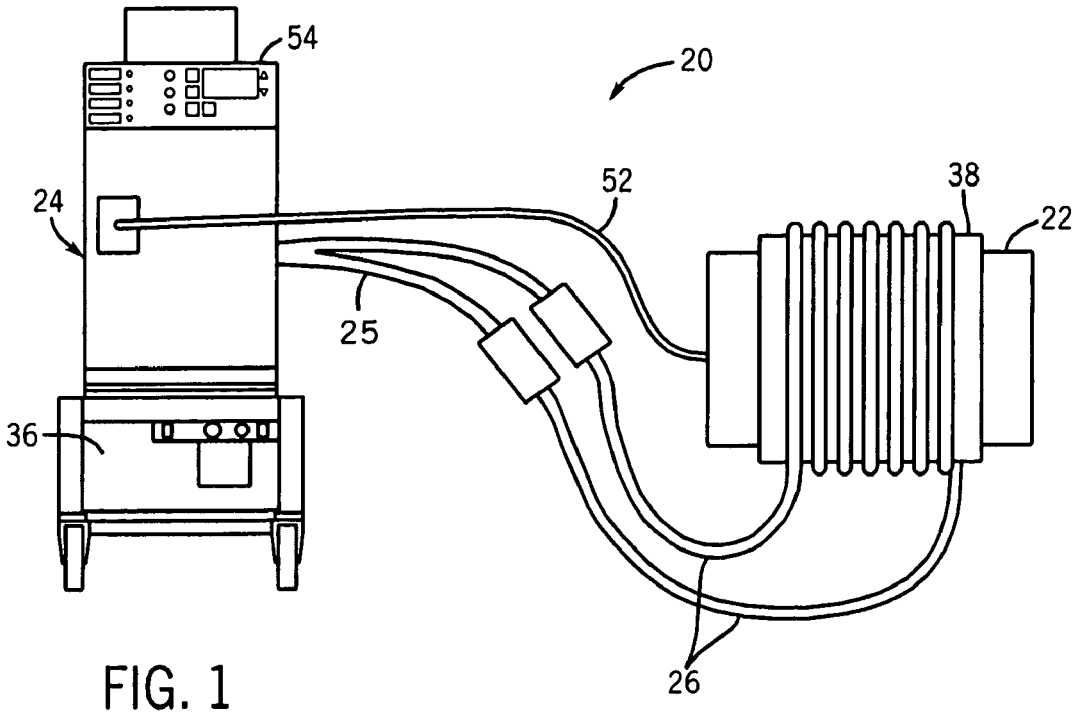
FIG. 1 is a diagrammatic illustration of an induction heating system, according to an exemplary embodiment of the present technique.

Referring generally to FIG. 1, a system 20 for inductively heating a work piece 22 is illustrated. In FIG. 1, the work piece 22 is a pipe comprising two circular pipe sections welded together and surrounded by a protective blanket 38. However, it is worth noting that the induction heating system 20 is operable to inductively heat a variety of different work pieces. In the illustrated embodiment, the induction heating system 20 comprises an induction heating power source 24, a fluid cooling unit 36, a fluid cooled extension cable 25, and a fluid-cooled induction heating cable 26. The induction heating cable 26 is flexible to enable the cable 26 to be wrapped around the work piece 22 to form a coil. Alternatively, the induction heating system 20 may comprise a induction heating power source 24, an air-cooled extension cable, an air-cooled induction heating cable, or an air-cooled induction heating blanket, for example.

Figure 2:
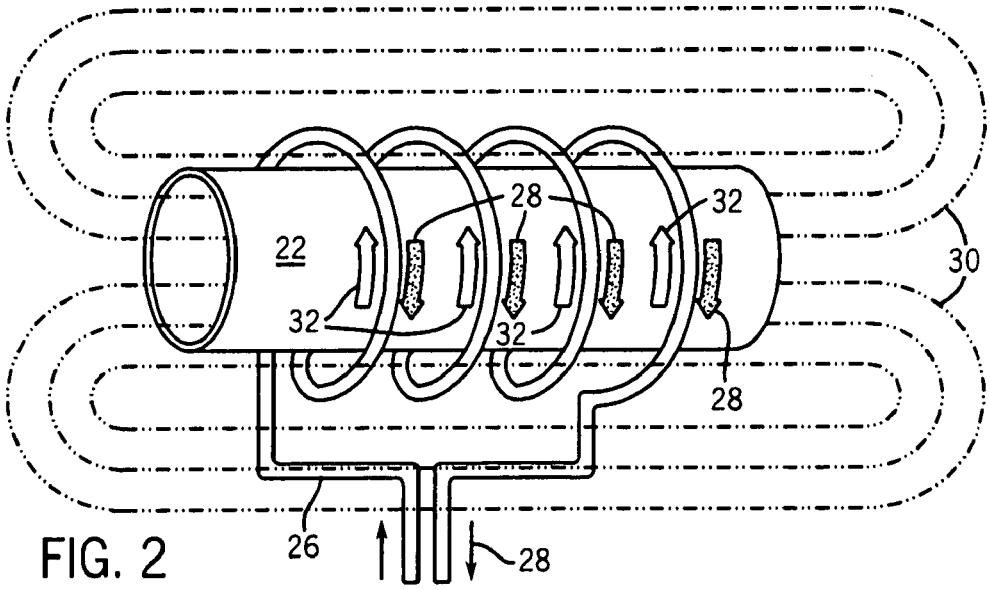
FIG. 2 is a diagram of the process of inducing heat in a work piece using a varying magnetic field, according to an exemplary embodiment of the present technique.

As illustrated in FIG. 2, the induction heating power source 24 is operable to produce an alternating electrical current 28 that is conducted through the fluid-cooled extension cable 25 to the fluid-cooled induction heating cable 26. The alternating electrical current 28 flowing through the fluid-cooled induction heating cable 26 produces a varying magnetic field 30 that induces a flow of eddy currents 32 in the work piece 22 and that, in turn, heats the work piece 22. Accordingly, controlling the level of the alternating electrical current from the induction heating power source 24 changes the strength of the magnetic field, thereby controlling the amount of heat generated in the work piece 22.

Referring generally to FIG. 3*a*, the fluid-cooled induction heating extension cables 25 have connectors 42 that engage with corresponding connectors 44 on the induction heating power source 24. The connectors conduct electricity from the power source 24 to the fluid-cooled induction heating extension cable 25. External to the connectors 42, cooling fluid from the fluid cooling unit 36 is provided to the fluid-cooled induction heating extension cable 25 via hoses 46. The connectors 44 also enable an air-cooled induction heating cable to be coupled to the induction heating power source 24. In this embodiment, as shown in FIG. 3*b*, protective covers 48 may be placed over connector 44 when not in use.

Referring generally to FIGS. 1 and 4, the induction heating system 20 is operable to receive temperature feedback from a plurality of temperature feedback devices 50, such as thermocouples, resistance temperature detectors (RTD's), or infrared sensors. These temperature feedback devices 50 facilitate heating of the work piece 22 to a desired temperature and/or at a desired rate of temperature change. However, other temperature feedback devices 50 may be used. The exemplary thermocouples 50 are secured to the work piece 22 by spot welding and are coupled to the induction heating power source 24 by an extension cable 52.

Referring generally to FIG. 5, the illustrated induction heating power source 24 has a control panel 54 that enables a user to program the induction heating power source 24 to perform a variety of heating operations. For example, the control panel 54 may be used to program the induction heating power source 24 to heat the work piece 22 at a desired heat-up rate. In addition, the induction heating power source 24 may be programmed to maintain the work piece 22 at an elevated temperature for a desired period of time. The induction heating power source 24 may also be programmed to reduce the work piece temperature from an elevated temperature at a desired cool-down rate. It is worth noting that a number of operating programs are envisaged, and the foregoing techniques are merely examples.

The exemplary control panel facilitates controlled operations of the induction heating power source and the induction heating device. This control panel 54 has four displays 56, one display for each of the four thermocouples 50 that are operable to control the operation of this embodiment of the induction heating power source 24. With the control panel, an operator may monitor the temperature displays 56 for differences in the temperatures of various portions of the work piece 22. The exemplary control panel 54 also has four control lights 58, one for each of the thermocouples 50 used to control temperature, to indicate which of the four control thermocouples 50 is controlling the operation of the system 20 at that point in time in the heating program. In addition, the illustrated control panel 54 has a main display 60 to facilitate the programming of the induction heating power source 24 and for monitoring system parameters, such as the output power, output voltage, current, and output frequency.

Additionally, the display 60 is capable of providing program status information as well as diagnostic information should a problem arise. In this embodiment, the control panel 54 has a cursor button 62 that may be used in cooperation with the main display 60 to program the induction heating power source 24. For example, the cursor button 62 may enable the user to select a desired heating function from a plurality of available heating functions, such as a heating the work piece 22 at a desired heat-up rate, maintaining the work piece at a desired temperature for a desired period of time, or lowering the temperature of the work piece 22 from an elevated temperature at a desired cool-down rate. In addition, the illustrated control panel 54 has an up arrow button 64 and a down arrow button 66 to enable a user to input data, such as a desired heat-up rate, a desired temperature, a desired time, and a desired cool-down rate.

The control panel 54 also has various buttons that may be used to control the operation of the induction heating system 20. For example, the illustrated control panel 54 has a run button 68, a hold button 70, and a stop button 72. The run button 68 enables a user to initiate operation of the induction heating system 20. The hold button 70 enables a user to pause operation of the induction heating system 20 temporarily and maintain work piece temperature and then restart operation of the induction heating system 20 in accordance with the programming instructions. For example, if the operator observes differences in work piece temperatures on the temperature displays 56, the operator may press the hold button 70 to pause heating operations, allowing the operator to take positive actions to correct the temperature difference, if necessary. The operator may adjust the position of the cable 26 as it is coiled on the work piece 22 to adjust the work piece 22 heating and, thereby, reduce any differences in temperatures, for instance. Operation restart of the induction heating system 20 in accordance with the programming instructions is achieved by pressing the run button 68. The stop button 72, however, halts operation of the system 20 completely. The control panel 54 may also have a light 74 to provide an indication to a user that a fault condition exists. Another light 76 may be provided to indicate to a user when an operating limit, such as output voltage or current, has been reached. Finally, a light 78 may be provided to indicate when power is being applied to the induction heating cables 26.

Figure 6:
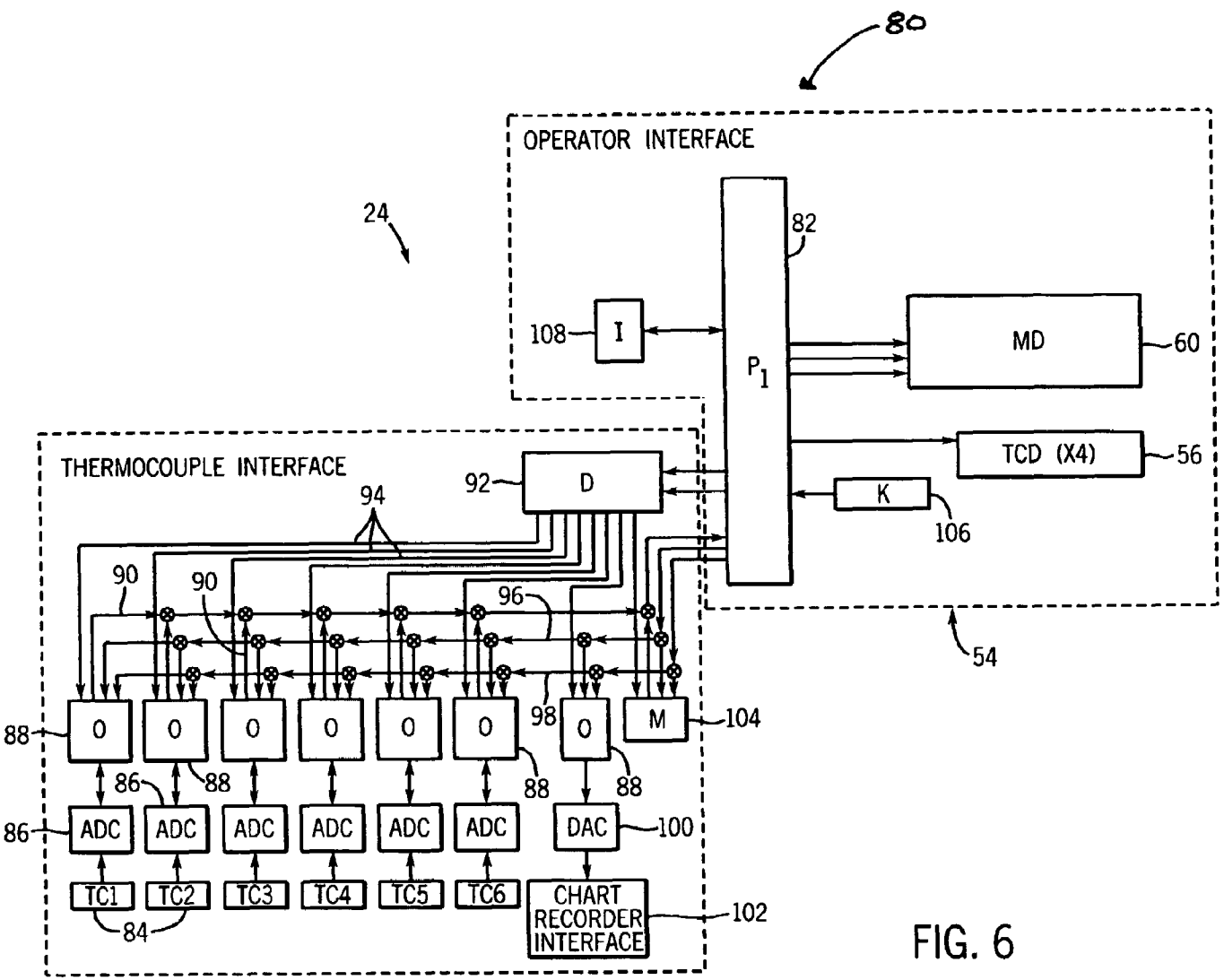
FIG. 6 is a schematic diagram of a temperature controller, according to an exemplary embodiment of the present technique.

Referring generally to FIG. 6, the induction heating power source 24 has a temperature controller circuit 80, that includes a thermocouple interface board 81 and the control panel 54 for operator interface, that provides a signal to direct the induction heating power source 24 to establish a desired temperature in the work piece. The temperature control circuit 80 utilizes a processor 82, located on the operator interface, that receives programming instructions from the control panel 54 that enable the processor 82 to establish the desired temperature in the work piece, or the desired rate of change of temperature, etc. In addition, the processor 82 receives actual work piece temperature data from the thermocouples 50 that enable the processor 82 to control the output of the induction heating power source 24 so that the actual work piece temperature is the desired work piece temperature. The illustrated induction heating power source 24 has six thermocouple inputs 84 to enable each of the six thermocouples 50 to be coupled to the temperature controller circuit 80. Each of the inputs 84 is coupled to an analog-to-digital converter (ADC) 86 that converts the analog temperature data from the thermocouples 50 into a digital temperature signal. Each ADC 86 is coupled to an optoisolator 88. Each optoisolator 88 couples the digital temperature signal from an ADC 86 to the processor 82 while maintaining electrical isolation of the processor 82 from each ADC 86. It is worth noting that multi-channel optoisolators are envisaged as well.

In this embodiment, the processor 82 receives digital temperature data from each ADC 86 sequentially. A number of circuit paths are provided to enable the processor 82 to communicate with each ADC 86 and a decoder 92. A first signal bus 90 is provided to couple the digital temperature data from each of ADC 86 to the processor 82. The decoder 92 is provided to control each ADC 86 to transmit the digital temperature data sequentially to the processor 82. A second signal bus 94 is provided to couple the decoder 92 to each ADC 86. A third signal bus 96 is provided to enable the processor 82 to communicate to each ADC 86. Each ADC 86 transmits its temperature data to the processor 82 when queued by the decoder 92 and the processor 82. A fourth signal bus 98 is provided to transmit calibration data to each ADC 86. A digital-to-analog converter (DAC) 100 is provided to couple the temperature data to a chart recorder via a chart recorder interface 102. In addition, a memory device 104 is provided to store calibration data.

The processor 82 receives programming instructions via various programming buttons 106 disposed on the control panel 54. However, other methods of programming the processor 82 may be used. The programming buttons 106 include the run button 68, the hold button 70, the stop button 72, the cursor button 62, the up arrow button 64, the down arrow button 66, etc. The processor 82 may also provide signals to the temperature displays 56 and the main display 60. The processor 82 produces an output signal that is coupled to a power source controller interface 108.

Figure 7:
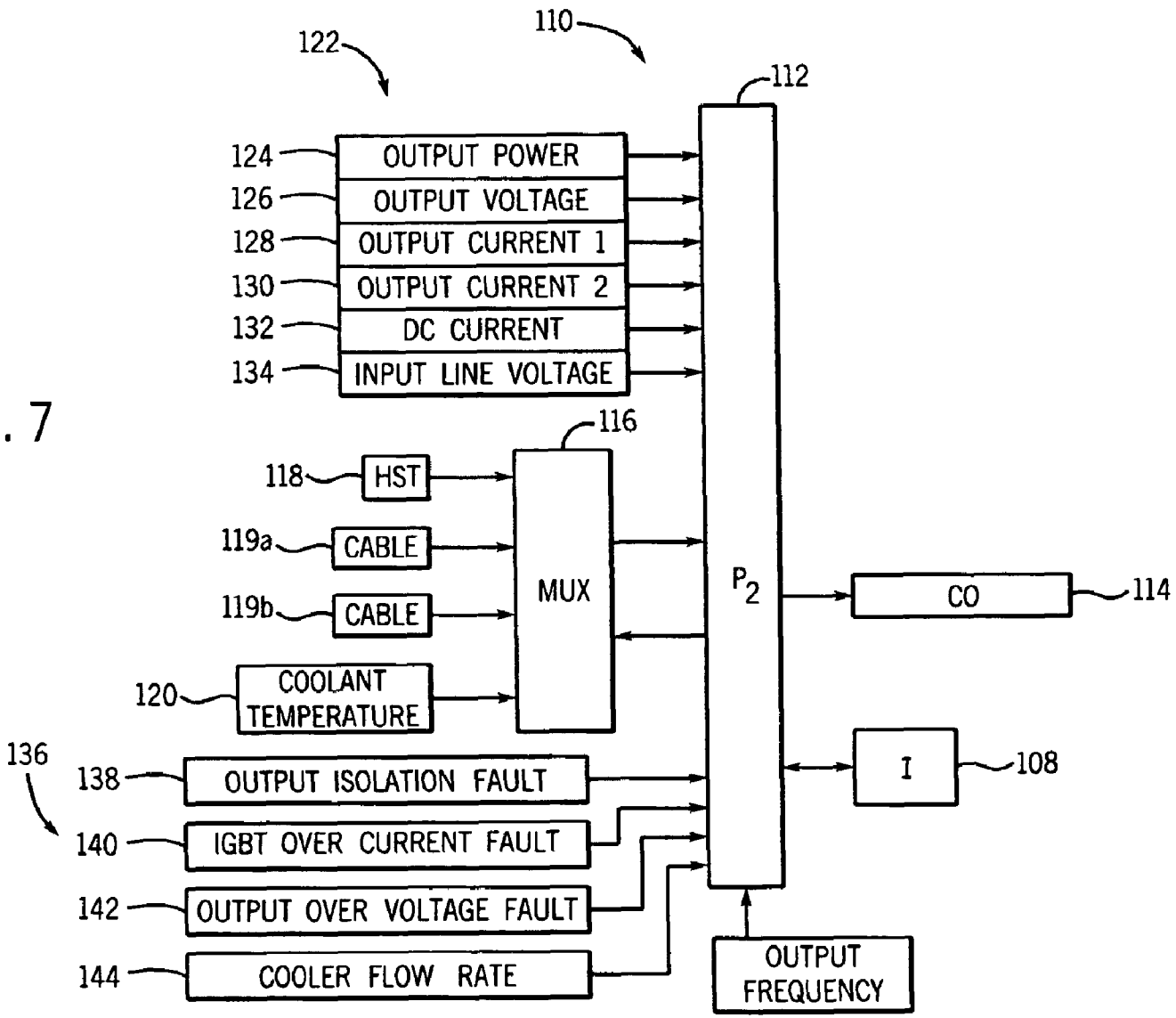
FIG. 7 is a schematic diagram of a power source controller, according to an exemplary embodiment of the present technique.

Referring generally to FIG. 7, a power source controller 110 establishes the actual output of the induction heating power source 24 based on the signal produced by the temperature controller circuit 80 and signals representative of operational parameters of the system. The power source controller 110 has a processor 112 that provides a command signal 114 that controls the output of the induction heating power source 24 based on the signal produced by the temperature controller circuit 80 and signals representative of operational parameters of the system. The processor 112 receives the signal produced by the temperature controller circuit 80 via the interface 108.

In this embodiment, the power source controller 110 is operable to limit or reduce the output of the induction heating power source 24 based on various operational parameters of the system. For example, the processor 112 can be programmed to limit output power of the induction heating power source 24 or reduce the output of the induction heating power source 24 when one of the operational parameters achieves or exceeds a corresponding first threshold amount. By limiting or reducing the output of the induction heating power source 24, potential damage to the components of the system may be prevented. For example, if the output of the induction heating power source 24 is reduced, then the amount of current flowing through the system is reduced. In addition, if the output of the induction heating power source 24 is reduced, then the amount of heat generated within the system is reduced. Both excessive current and heat are sources of potential damage to components of the system. Therefore the likelihood of damage to various components of the system is mitigated by reducing the amount of current or heat generated within the system. Similarly, by limiting the system output, the amount of heat and current may be blocked from rising to a level that may cause damage to components of the system. In addition, the processor 112 is programmed to shut down the induction heating power source 24 when one of the operational parameters achieves or exceeds a second defined threshold amount greater than the first threshold amount.

The processor 112 is operable to receive a plurality of signals representative of operational parameters of the system. In this embodiment, the processor 112 receives signals from a multiplexer 116. As will be discussed in more detail below, the multiplexer 116 receives one or more thermistor inputs 118 from a plurality of thermistors disposed within the induction heating power source 24 (e.g., thermistors 166, 172, and 174, illustrated in FIG. 8), and couples them to the processor 112. The multiplexer 116 also receives an input 119*a* and 119*b* from the cable connectors 44 of FIG. 3. Furthermore, the multiplexer 116 also receives a coolant temperature input 120 from the fluid cooling unit 36 of FIG. 1. In addition, the power source controller 110 is operable to receive signals representative of other operational parameters of the system, such as operational voltage, current, and power data 122. For example, in the illustrated embodiment, the power source controller 110 receives a signal representative of output power 124, a signal representative of output voltage 126, a signal representative of output current 128 for a first output of the induction heating power source 24, a signal representative of output current 130 for a second output of the induction heating power source 24, a signal representative of DC current 132 from within the induction heating power source, and a signal representative of input line voltage 134 from within the induction power unit 24.

In addition, the power source controller 110 is operable to shut down or limit operation of the induction heating power source 24 when signals representative of specific operational parameters are received. The specific operational parameters, represented generally by reference numeral 136, comprise a number of fault signals representative of a fault condition in the system that may result in damage to the system if operation continues. The processor 112 is programmed to direct the induction heating power source 24 to shut down and discontinue supplying power when one of the fault signals 136 is received. In this embodiment, the specific operational parameter inputs 136 comprise an output isolation fault signal 138, an IGBT over-current fault signal 140, and an output overvoltage fault signal 142. As will be discussed in more detail below, the IGBTs are used in a pair of inverter circuits to produce alternating current from direct current. In addition, the power source controller 110 also receives a fault signal 144 when fluid flow rate through the fluid cooling unit 36 of FIG. 1 falls below a threshold amount. It is worth noting that the foregoing fault signal and events are merely but some examples. For example, the processor 112 can receive output frequency, and, if this frequency exceeds a threshold level, reduce the output power to protect the output connectors 44, for instance.

Figure 8:
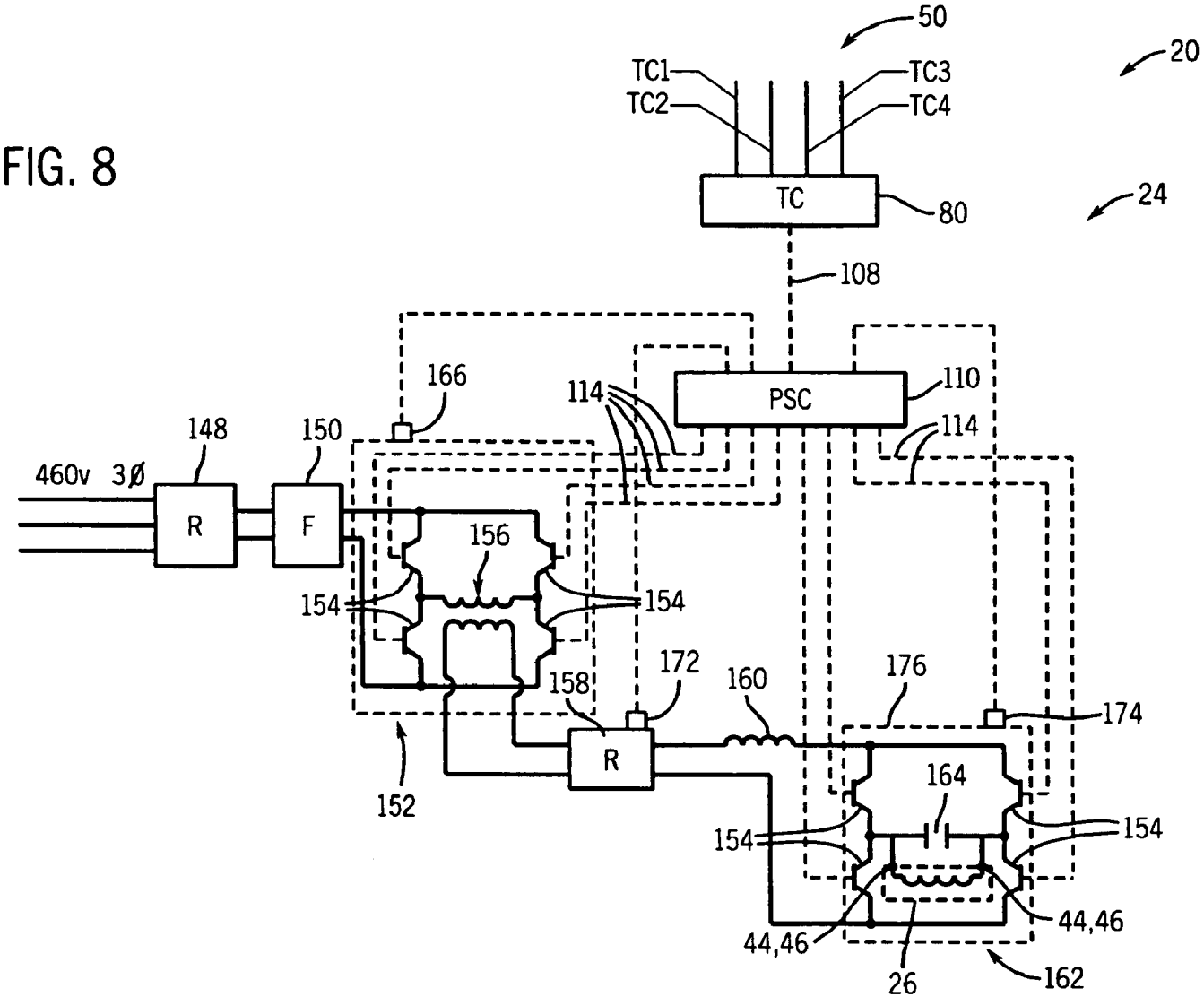
FIG. 8 is a schematic diagram of the induction heating system, according to an exemplary embodiment of the present technique.

Referring generally to FIG. 8, an electrical schematic of the induction heating system 20 is illustrated. The temperature controller 80 receives the temperature feedback from the plurality of temperature feedback devices 50. The temperature controller 80 compares the actual temperature of the work piece 22, represented by the temperature feedback, to a desired temperature based on programming instructions stored in the temperature controller 80. The temperature controller 80 provides a signal 108 to the power source controller 110 that is representative of a desired output of the induction heating power source 24 to make the actual temperature of the work piece 22 equal to the desired temperature. The power source controller 110 controls the operation of the induction heating power source 24 to provide the desired output. As will be discussed in more detail below, the power source controller 110 controls the output of the induction heating power source 24 by controlling the opening and closing of electronic switches in a pair of inverter circuits. By selectively increasing or decreasing the frequency that the electronic switches 154 are opened and closed, the output of the induction heating power source 24 may be increased or decreased as desired.

In the illustrated embodiment, three-phase AC input power is coupled to the induction heating power source 24 to provide the power to enable the induction heating power source 24 produce a desired output. A signal representative of the line voltage is coupled to the processor 112 of the power source controller 110 illustrated in FIG. 7. A rectifier 148 is used to convert the AC power into DC power, and a filter 150 is used to condition the rectified DC power signals.

A first inverter circuit 152 is provided to invert DC power into desired AC output power. In the illustrated embodiment, the first inverter circuit 152 comprises a plurality of electronic switches 154, such as IGBTs. The electronic switches 154 are opened and closed by command signals 114 from the power source controller 110. The power source controller 110 controls the operation of the electronic switches 154 to provide the desired output of the induction heating power source 24. A signal representative of the IGBT current is coupled to the process illustrated in FIG. 7. A step-down transformer 156 is used to couple the AC output from the first inverter circuit 152 to a second rectifier circuit 158, where the AC is converted again to DC. A signal representative of the direct current from the second rectifier 158 is coupled to the processor 112 illustrated in FIG. 7. An inductor 160 is used to smooth the rectified DC output from the second rectifier 158.

A second inverter circuit 162 is provided to invert the DC output of the second rectifier 158 into a high-frequency AC signal. The electronic switches 154 of the second inverter circuit 162 also are opened and closed by command signals 114 from the power source controller 110. The power source controller 110 controls the operation of the electronic switches 154 to provide the desired output of the induction heating power source. A tank capacitor 164 is coupled in parallel with the connectors 44. As illustrated, the fluid-cooled induction heating cable 26 is connected to connectors 44. However, an air-cooled device may be coupled to connectors 44. Signals representative of the output power, voltage and currents are coupled to the processor 112 of the power source controller 110 illustrated in FIG. 7.

The coiled induction heating cable 26 is represented on the schematic as an inductor. The inductance of the induction heating cable 26 and the tank capacitor 164 form a resonant tank circuit. The inductance and capacitance of the resonant tank circuit establishes the frequency of the AC current flowing through the fluid-cooled induction heating cable 26. The inductance of the fluid-cooled induction heating cable 26 is influenced by the number of turns of the heating cable 26 around the work piece 22. As discussed above, the current flowing through the fluid-cooled induction heating cable 26 produces the magnetic field that induces eddy current flow, and, thus, heat in the work piece 22.

A large amount of electrical current may flow through the various components of the induction heating power source 24 and the induction heating cable 26. This current produces heat that may damage the components. Solid-state components, such as the IGBTs 154 and the rectifiers, are particularly susceptible to heat damage. In the illustrated embodiment, the system 20 is adapted to control operation of the system 20 to prevent heat damage to certain components. One or more temperature feed back devices, such as thermistors, are disposed within the induction heating power source 24 to provide temperature signals to the power source controller 110. For example, in the illustrated embodiment, a first thermistor 166 is disposed adjacent to the first inverter circuit 152, to provide a signal representative of the temperature of the first inverter circuit 152 to the power source controller 110. A second thermistor 172 is provided to provide a signal representative of the temperature of the rectifier 158 to the power source controller 110. Finally, a third thermistor 174 is disposed to the second inverter 162, to provide a signal representative of the temperature of the second inverter 162 to the power source controller 110.

In addition to the signal 108 from the temperature controller 80 that is representative of a desired output of the induction heating power source 24, the power source controller 110 also receives temperature signals from the first thermistor 166, the second thermistor 172, the third thermistor 174, and a coolant temperature signal 120 from the fluid cooling unit (illustrated in FIG. 7). The power source controller may be programmed with a variety of control schemes to control the output of the induction heating power source 24 based on the temperature signals from the induction heating system components. For example, the power source controller 110 may be programmed to limit the signal 108 from the temperature controller to direct the induction heating system not to produce additional power when a specified induction heating system component temperature is reached. Alternatively or in addition to the previous example, the power source controller 110 may be programmed to reduce the signal 108 from the temperature controller to direct the induction heating system to produce less power when a specified induction heating system component temperature is reached. The power source controller 110 may even be programmed to halt operation of the induction heating power source 24 if a specified component temperature is reached or exceeded. Limiting or reducing the desired output of the induction heating power source 24 reduces the amount of current and heat produced within the system 20. Thus, the induction heating system components are protected from damage.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims. For example, although the systems described above is an induction heating system, the technique can be used with a resistive heating system, a welding system, or any of a myriad of systems that utilize power sources to supply power.

What is claimed is:

1. An induction heating power source, comprising:

a power source controller operable to direct the induction heating power source to produce a desired output to heat a work piece to a desired temperature, wherein the power source controller is operable to receive a signal representative of an operational parameter of the induction heating power source and is operable to limit the output of the induction heating power source to a level below the desired output to heat the work piece to the desired temperature when the signal representative of an operational parameter of the induction heating power source achieves a first threshold value; and wherein the induction heating power source comprises a temperature controller operable to provide a signal to direct the power source to produce the desired output to heat the work piece to the desired temperature, wherein the power source controller controls the output of the power source based on the signal from the temperature controller and the signal representative of an operational parameter of the power source.

2. The induction heating power source as recited in claim 1, wherein the power source controller is operable to deactivate the induction heating power source when the signal representative of an operational parameter of the induction heating power source achieves a second threshold value, the second threshold value being greater in value than the first threshold value.

3. The induction heating power source as recited in claim 1, wherein the signal representative of an operational parameter comprises a signal representative of temperature of a power source component.

4. The induction heating power source as recited in claim 1, wherein the signal representative of an operational parameter comprises a signal representative of a current flowing through the induction heating power source.

5. The induction heating power source as recited in claim 1, wherein the signal representative of an operational parameter data comprises a signal representative of output voltage of the induction heating power source.

6. The induction heating power source as recited in claim 1, wherein the signal representative of an operational parameter comprises a signal representative of output power of the induction heating power source.

7. The induction heating power source as recited in claim 1, comprising:

a power source component;

a temperature feedback device configured to generate a signal representative of temperature of the power source component; and wherein the power source controller is communicatively coupled to the temperature feedback device and the power source component, and the power source controller is configured to establish a desired output of the power source component based on the signal representative of temperature.

8. The induction heating power source as recited in claim 7, wherein the power source controller is configured to limit the desired output of the power source component to a defined output when the temperature rises to a defined temperature.

9. The induction heating power source as recited in claim 7, wherein the power source controller is configured to establish the desired output of the power source component based on another signal representative of temperature of a stationary work piece and a desired temperature of the stationary work piece.

10. The induction heating power source as recited in claim 7, wherein the power source component comprises a plurality of power source components, and each power source component has a temperature feedback device configured to transmit a signal representative of temperature of the respective power source component to the power source controller, and wherein the power source controller is configured to establish the desired output of each power source component based on the plurality of signals representative of temperature.

11. The induction heating power source as recited in claim 7, wherein the power source component comprises an inverter, or a rectifier, or an IGBT, or a solid state component, or a combination thereof.

12. The induction heating power source as recited in claim 7, wherein the power source controller is configured to control the induction heating power source based on a signal representative of an operational parameter of a liquid coolant.

13. The induction heating power source as recited in claim 12, wherein the power source controller is configured to at least limit output power of the induction heating power source if the signal representative of the operational parameter of the liquid coolant at least reaches a threshold.

14. The induction heating power source as recited in claim 13, wherein the signal representative of the operational parameter of the liquid coolant comprises a coolant temperature, and the threshold comprises a threshold coolant temperature.

15. The induction heating power source as recited in claim 13, wherein the signal representative of the operational parameter of the liquid coolant comprises a coolant flow rate, and the threshold comprises a threshold coolant flow rate.

16. The induction heating power source as recited in claim 1, wherein the power source controller is configured to control the induction heating power source to produce a desired output to heat a stationary work piece to a target temperature, wherein the power source controller is configured to at least limit output of the induction heating power source to a level below the desired output if a power source component at least reaches or exceeds a first threshold operational value.

17. The induction heating power source as recited in claim 16, wherein the power source controller is configured to at least limit output of the induction heating power source to a suitable level below the desired output if a component of a system powered by the induction heating power source at least approaches or achieves a second threshold operational value.

18. The induction heating power source as recited in claim 17, wherein the second threshold operational value comprises a threshold coolant flow rate, or a threshold coolant temperature, or a combination thereof.

19. The induction heating power source as recited in claim 16, wherein the power source component comprises an inverter, or a rectifier, or an IGBT, or a solid state component, or a combination thereof.

20. The induction heating power source as recited in claim 19, wherein the first threshold operational value comprises a threshold temperature, or a threshold current, or a combination thereof.

21. The induction heating power source as recited in claim 1, comprising an air-cooled induction heating cable coupled to the induction heating power source.

22. The induction heating power source as recited in claim 1, comprising an induction heating cable coupled to the induction heating power source.

23. The induction heating power source as recited in claim 22, wherein the induction heating cable comprises a fluid-cooled induction heating cable.

24. The induction heating power source as recited in claim 1, comprising a control panel coupled to the power source controller, wherein the control panel comprises a display configured to indicate the operational parameter.

25. The induction heating power source as recited in claim 24, wherein the display is configured to indicate when the first threshold value has been reached.

26. A method of operating an induction heating device, comprising:

controlling an induction heating power source to produce a desired output to heat a work piece to a desired temperature, comprising:

receiving a first signal representative of an operational parameter of the induction heating power source; and providing a second signal to direct the induction heating power source to produce the desired output to heat the work piece to the desired temperature, comprising limiting output of the induction heating power source to a level below the desired output to heat the work piece to the desired temperature when the first signal achieves a first threshold value.

27. A method of manufacturing an induction heating device, comprising:

providing a power source controller operable to direct an induction heating power source to produce a desired output to heat a work piece to a desired temperature, wherein the power source controller is operable to receive a signal representative of an operational parameter of the induction heating power source and is operable to limit the output of the induction heating power source to a level below the desired output to heat the work piece to the desired temperature when the signal representative of an operational parameter of the induction heating power source achieves a first threshold value; and wherein the induction heating power source comprises a temperature controller operable to provide a signal to direct the induction heating power source to produce the desired output to heat the work piece to the desired temperature, wherein the power source controller controls the output of the induction heating power source based on the signal from the temperature controller and the signal representative of an operational parameter of the induction heating power source.

* * * * *